US009598929B2

(12) United States Patent
Patel et al.

(10) Patent No.: US 9,598,929 B2
(45) Date of Patent: Mar. 21, 2017

(54) COMPLETIONS ASSEMBLY WITH EXTENDABLE SHIFTING TOOL

(71) Applicant: Schlumberger Technology Corporation, Sugar Land, TX (US)

(72) Inventors: Dinesh R. Patel, Sugar Land, TX (US); Philippe Gambier, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 669 days.

(21) Appl. No.: 13/796,647

(22) Filed: Mar. 12, 2013

(65) Prior Publication Data

US 2013/0192848 A1 Aug. 1, 2013

Related U.S. Application Data

(63) Continuation-in-part of application No. 13/741,996, filed on Jan. 15, 2013.

(60) Provisional application No. 61/586,959, filed on Jan. 16, 2012, provisional application No. 61/586,967, filed on Jan. 16, 2012.

(51) Int. Cl.

| | |
|---|---|
| ***E21B 34/06*** | (2006.01) |
| ***E21B 34/14*** | (2006.01) |
| *E21B 43/12* | (2006.01) |

(52) U.S. Cl.
CPC ..... *E21B 34/06* (2013.01); *E21B 34/14* (2013.01); *E21B 43/12* (2013.01)

(58) Field of Classification Search
CPC ..... E21B 34/06; E21B 34/14; E21B 43/12; E21B 43/14
See application file for complete search history.

(56) References Cited

U.S. PATENT DOCUMENTS

| | | | |
|---|---|---|---|
| 4,350,205 | A | 9/1982 | Goldschild et al. |
| 6,607,031 | B2 | 8/2003 | Lynde et al. |
| 6,651,744 | B1 | 11/2003 | Crawford |
| 7,735,555 | B2 | 6/2010 | Patel et al. |
| 7,775,275 | B2 | 8/2010 | Patel et al. |
| 7,896,079 | B2 | 3/2011 | Dyer et al. |

(Continued)

OTHER PUBLICATIONS

Middleton et al., Application of a Unique Deepset Safety Valve Below an ESP in a Naturally Flowing Offshore Gulf of Mexico Well.

(Continued)

*Primary Examiner* — Nicole Coy
(74) *Attorney, Agent, or Firm* — Jeffery R. Peterson

(57) ABSTRACT

A completions assembly that includes an extendable and retractable shifting tool at a lower end of an upper completion. Outfitted with this type of tool, the upper completion may be sealably landed out at an installed lower completion without prematurely opening an isolation valve that ensures well control thereat. Rather, the full completions assembly may be finished out and the valve later opened by extending of the shifting tool from the upper completion toward the isolation valve at the lower completion. Once more, this type of well control is achieved through use of hydraulic lines that are dedicated to the upper completion even though the isolation valve is located therebelow. As a result, the extended use of hydraulic couplings and other complex or wear-prone well control architecture may be largely avoided.

10 Claims, 5 Drawing Sheets

(56) References Cited

U.S. PATENT DOCUMENTS

| | | | | |
|---|---|---|---|---|
| 8,382,457 | B2 | 2/2013 | Wilson et al. | |
| 8,813,855 | B2 * | 8/2014 | Lake | 166/373 |
| 8,955,600 | B2 * | 2/2015 | Lauderdale et al. | 166/373 |
| 9,062,530 | B2 * | 6/2015 | Patel et al. | |
| 2007/0295504 | A1 | 12/2007 | Patel | |
| 2008/0223585 | A1 | 9/2008 | Patel et al. | |
| 2009/0078407 | A1 | 3/2009 | Carro | |
| 2010/0163235 | A1 | 7/2010 | Mootoo et al. | |
| 2010/0175894 | A1 | 7/2010 | Debard et al. | |
| 2011/0005772 | A1 | 1/2011 | Ceccarelli et al. | |
| 2011/0139465 | A1 | 6/2011 | Tibbles et al. | |
| 2012/0255738 | A1 | 10/2012 | Lauderdale et al. | |
| 2013/0019969 | A1 | 1/2013 | Scarsdale | |
| 2013/0075108 | A1 * | 3/2013 | Frisby | E21B 34/00 166/373 |
| 2013/0075109 | A1 * | 3/2013 | Frisby | E21B 43/128 166/373 |
| 2013/0180735 | A1 | 7/2013 | Patel | |

OTHER PUBLICATIONS

International Search Report and Written Opinion mailed on May 8, 2013 for PCT/US2013/021671, dated Jan. 16, 2013, 10 pgs.

Russian Appl. No. 2014133528, First Office Action dated Jun. 4, 2015, 6 pgs.

* cited by examiner

COMPLETIONS ASSEMBLY WITH EXTENDABLE SHIFTING TOOL

PRIORITY CLAIM/CROSS REFERENCE TO RELATED APPLICATION(S)

This patent Document is a Continuation-In-Part claiming priority under 35 U.S.C. §120 to U.S. application Ser. No. 13/741,996, entitled "Completions Fluid Loss Control System", filed Jan. 15, 2013 and which in turn claims priority under 35 U.S.C. §119 to U.S. Provisional App. Ser. Nos. 61/586,959 and 61/586,967, entitled "Completion System with ESP Run" and "Completion System for Subsea ESP Run" respectively, both filed on Jan. 16, 2012, all of which are incorporated herein by reference in their entireties.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, the terminal end of a cased well often extends into an open-hole section. Thus, completions hardware may be fairly complex and of uniquely configured parts, depending on the particular location and function to be served. For example, in addition to the noted casing, the hardware may include gravel packing, sleeves, screens and other equipment particularly suited for installation in the open-hole section at the end of the well. However, hardware supporting zonal or formation isolation may be located above the open-hole section. Further, certain features such as chemical injection lines may traverse both cased and open-hole well regions. Once more, such complex architecture may need to remain flexible enough in terms of design and installation sequence so as to account for perforating, fracturing, gravel packing and a host of other applications that may be employed in completing the well.

With the above factors in mind, the sequence of hardware installation, following drilling and casing of the well, may begin with gravel packing directed at the open-hole productive region of the well. In terms of hardware delivery for a corresponding lower completion, this may include the installation of screen equipment, a gravel pack packer, a frac sleeve and other features at this productive interface. The result is a cased well that now terminates at a lower completion having at least a temporary degree of fluid control with frac sleeves closed over the formation interface at the lower completion. Further, subsequently, or in conjunction with, the lower completion installation, a more secure mechanical formation isolation valve (MFIV) may be installed. Thus, a more reliable and permanent form of control may be provided.

Generally, once the MFIV is installed, it is also simultaneously closed as the installation tools are removed from the well. For example, a shifting tool at the end of a workstring may close the valve automatically as the workstring is removed. Thus, the upper completion may be subsequently installed over, and in communication with the MFIV as overall completions are finished out.

In many cases, the upper and lower completions are connected together at the location of the MFIV, perhaps through an intermediate completion, and with hydraulic control through each completion segment so as to maintain control over the MFIV. For example, wet-mate hydraulic connections may be utilized to couple hydraulic lines of the various completions segments and to the MFIV. In this manner, control over opening and closing of the valve from surface may be provided. Thus, when the upper completion is fully landed and secured, the MFIV may be opened via hydraulic control from surface.

Unfortunately, seals in downhole hardware will degrade over time and may start leaking. This may require a major work over of the completion which is very expensive. Also sealed connections between lines through a wet-mating hydraulics may not be as reliable, for example in the presence of natural debris in the downhole environment. So, for example, while the life of the well may be upwards of twenty years, seals are unlikely to remain reliable for as many as ten years. Thus, control over the MFIV is likely lost at some point with opening and closing thereafter, requiring a more costly and time consuming dedicated intervention. For example, well operations may be brought to a halt and a shifting tool at the end of a coiled tubing or other suitable conveyance may be run into the well to open and close the MFIV as needed. Such interventions are not only costly, they are not always practical. That is, in many cases, an electric submersible pump (ESP) or other later installed production hardware may have been located within the wellbore and act as an impediment to accessing the MFIV through such an intervention. As a result, a degree of equipment removal and follow-on workover may be required just to be able to open or close the MFIV a single time.

Efforts have been undertaken to exercise control over the MFIV without reliance on wet-mate hydraulics or follow on dedicated intervention. This is particularly the case for wells that are configured to employ ESP-type equipment within the wellbore at the onset of well operations. For example, the upper completion may be outfitted with a shifting tool at the end thereof. Thus, the MFIV may be initially opened in conjunction with the installation of the upper completion. As a result, communication throughout the wellbore, between completion segments, is attained as soon as the upper completion is installed.

Unfortunately, utilizing a shifting tool that extends from below the upper completion segment to automatically open the MFIV means that the MFIV will open before the upper completion is fully landed out and sealably installed. Thus, where a significant pressure differential is present in the bore of the isolated lower completion, well control may be lost for a period of time as the upper completion is installed. An attempt may be made to quickly raise the upper completion and close the valve. However, where pressure is high enough this could translate into a blowout of catastrophic proportions nonetheless. As a result, where such lower wellbore pressures are considered likely, operators are left with the only practical option of wet-mate hydraulics and dedicated interventions, irrespective of the limited life and overall expenses which may be involved.

SUMMARY

A completions assembly employing upper and lower completions hardware which are joined in the vicinity of an isolation valve. The valve may be configured to maintain well control between the completions hardware in advance of fluid communication therebetween. Additionally, the upper completions hardware in particular may be outfitted with an extendable shifting tool so as to allow such fluid communication after this hardware has been securely landed at the installed lower completion. Once more, the extendable shifting tool may be retractable so as to allow re-closure of the valve. In one embodiment the retractable nature of the shifting tool may be fail-safe such as in response to a contingent well control event.

DETAILED DESCRIPTION

Embodiments are described with reference to certain completion assemblies and manners of installation and follow-on well control. In particular, lower and upper completion assemblies are detailed that are configured for installation along with an isolation valve, generally a barrier valve or mechanical formation isolation valve (MFIV). Additionally, the barrier valve may be a ball valve, a sliding sleeve, or a flapper valve sealing in one or both directions. In particular, lower completion installation with MFIV precedes upper completion installation. Once more, this may be achieved with the aid of techniques and tools, such as an extendable shifting tool of the upper completion. Thus, the MFIV may be controlled without the requirement of dedicated intervention while also avoiding risk of premature opening or added hydraulic connections between upper and lower completions. However, these types of concepts may be utilized in other types of completion architecture. For example, the isolation valve may be of a type other than MFIV.

Additionally, intermediate completions and a host of other hardware may be utilized in conjunction with the assembly. Indeed, as used herein, the terms "upper" and "lower" completions are meant as orientational reference to one another. For example, either may be technically of an intermediate character with added completion segments thereabove or below. Regardless, so long as a form of "upper" completion hardware above the "lower" completion and isolation valve is outfitted with an extendable shifting tool for post-landing engagement with the valve, advantages as detailed herein may be realized.

Figure 1:
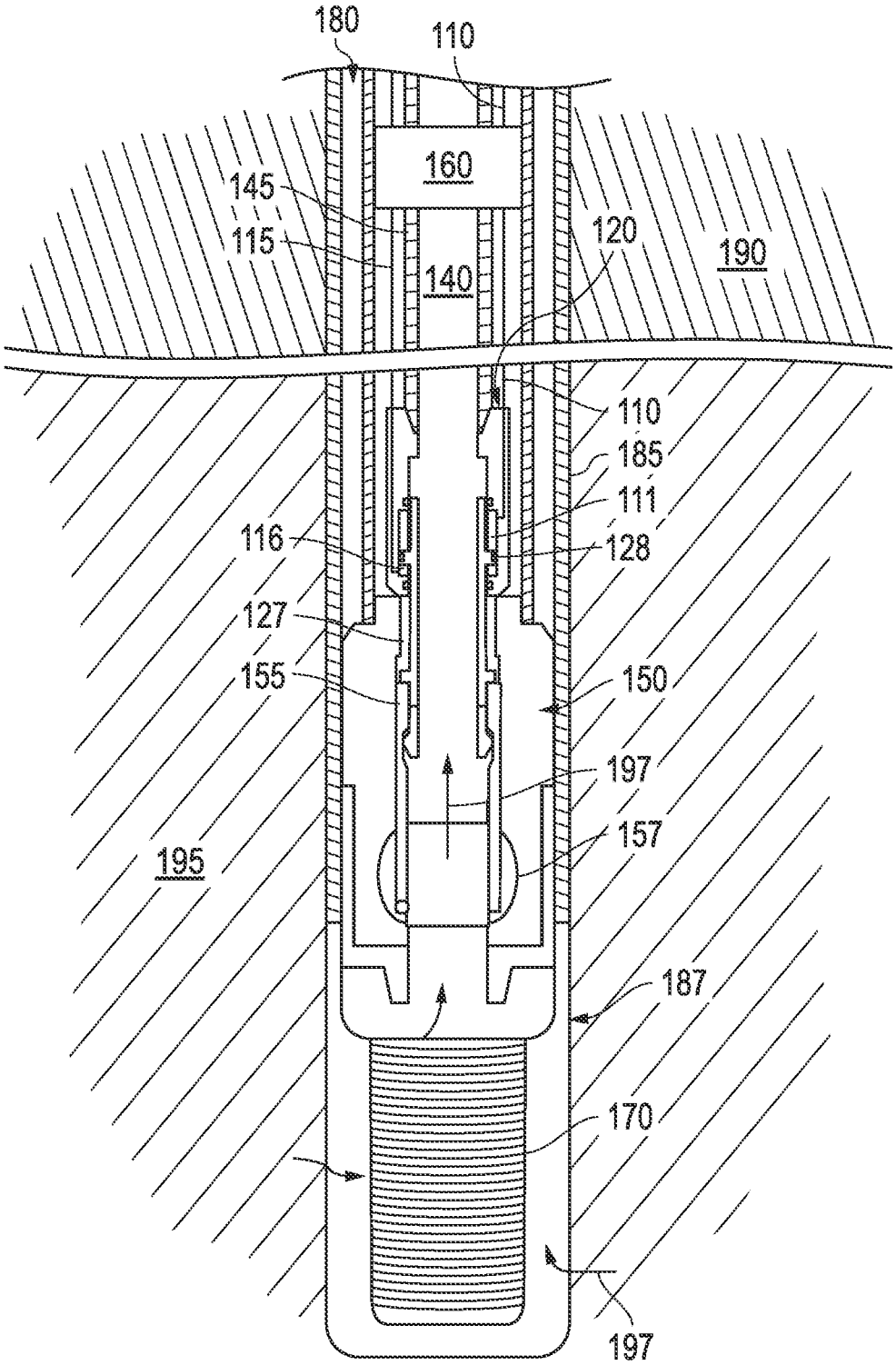
FIG. 1 is a side view of a lower completion with an isolation valve opened by an embodiment of an extendable shifting tool from an upper completion thereabove.

Referring now to FIG. 1, a side view of a completion assembly in a well 180 is depicted. Specifically, a lower completion 150 of the assembly is shown with an isolation valve 157 in an open position. For example, note the flow of downhole fluid 197 therethrough. Further, in the embodiment shown, this fluid 197 is production fluid and the valve 157 is a formation isolation valve as detailed further below. The valve 157 is located at the interface of the lower completion 150 and an upper completion 120 so as to maintain well control, for example over the production 197 or other well fluids. Regardless, the upper completion 120 accommodates an extendable shifting tool 127 that is configured to latchingly engage an operator arm 155 of the valve 157. This in turn allows for surface control over the valve 157 once the upper completion 120 is sealably landed at the lower completion 150.

Continuing with reference to FIG. 1, the noted control over the valve 157 is exercised by the upward or downward shifting movement of the shifting tool 127. Specifically, in the embodiment shown, the tool 127 may be operated in a piston-like fashion by way of pressurizable chambers 111, 116 at either side of a head 128 of the tool 127. For example, as shown in FIG. 1, a downward shift of the tool 127 is effectuated by an opening hydraulic control line 110 that is coupled to the upper chamber 111 for pressurization thereof. Thus, the tool 127 is shifted and the valve 157 responsively opened. Of course, pressurization of this line 110 and chamber 111 may subsequently be exchanged for pressurization of the lower chamber 116 via a closing hydraulic control line 115 so as to shift the tool 127 upward and close the valve 157.

It is of note that the above described shifting of the tool 127 is exercised upon attaining a sealed and completed landing of the upper completion 120 which is equipped with the tool 127, hydraulic lines 110, 115 and other appropriate hardware. That is, as opposed to risking premature shifting or opening of the valve 157, the tool 127 is shiftable in nature. This means that it may remain retracted to a degree within the upper completion 120 as this completion 120 is sealably landed out. As a result, any protruding or extending character of the tool 127 is not to a degree that might prematurely begin to open the isolation valve 157. Rather, this is safely achieved through the opening line 110 via affirmative direction of an operator at the surface of the oilfield which accommodates the depicted well 180.

In the embodiment shown, the well 180 is defined by a casing 185, traversing various formation layers 190, 195 and ultimately terminating in an open-hole section 187. Hardware of the lower completion 120 in this section 187 may include a permeable screen 170 and other features configured to promote the uptake of production fluids 197 as alluded to above. Indeed, with a finished out completion assembly in place, these fluids 197 may travel through the lower 150 and upper 120 completions through a channel 140 and production tubing 145 all the way to surface. In the embodiment shown, the described isolation valve 157, or MFIV, is in an open position so as to allow this type of production to take place. Once more, the upper completion 120 is outfitted with an electric submersible pump 160 (ESP) so as to encourage such fluid uptake.

However, at other times, for example, in advance of the finished out completion assembly, the MFIV 157 may be closed. The closed MFIV 157 may be a safeguard against premature production or even a potential blowout where high pressure conditions are present in the open-hole section 187. Furthermore, even where high pressure conditions are not present in the open-hole section 187, a closed MFIV 157 may prevent potentially heavier uphole fluids from harming the well 180 by entering the section 187 or surrounding formation 195.

Continuing with reference to FIG. 1, when ready for production the MFIV 157 is opened as shown and production may be aided by the above-noted ESP 160. While occluding the channel 140, the ESP 160 is configured to allow for the bypass of production fluid 197 from below continuing through production tubing 145 thereabove. Additionally, even though the ESP 160 occludes the channel 140, opening and closing of the MFIV 157 for sake of production is achieved through the noted hydraulic lines 110, 115. Thus, the need to circumvent an obstructive ESP 160 with an interventional shifting tool to open or close the valve 157 is unnecessary. Rather, as alluded to above, the operator at surface may maneuver the valve 157 via the lines 110, 115 without requirement of a sophisticated intervention. In fact, the lines 110, 115 themselves are of unitary construction, run along the length of the upper completion 120 without requirement of hydraulic coupling to the lower completion 150 in order to reach the MFIV 157. Thus, more sophisticated, and often shorter-lived, hydraulic couplings also need not be relied upon for maneuvering of the MFIV 157 as described.

Figure 2C:
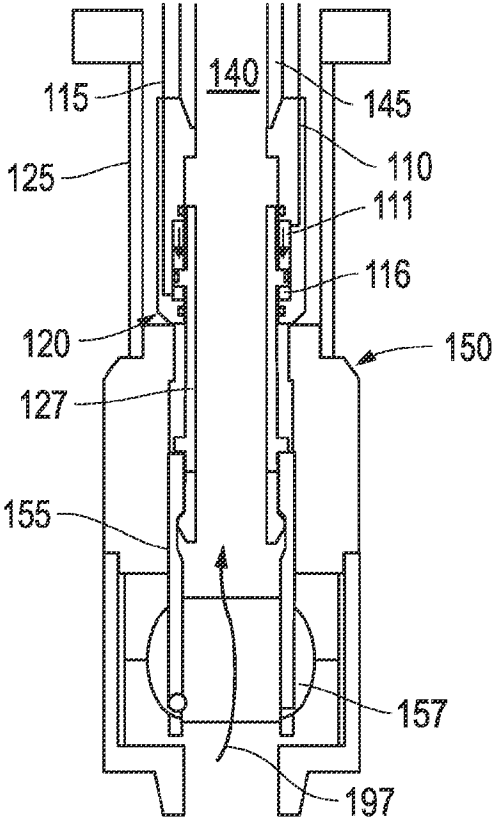
FIG. 2C is a side view of the extendable shifting tool of FIGS. 1 and 2B extending from the upper completion to open the isolation valve.
Figure 2B:
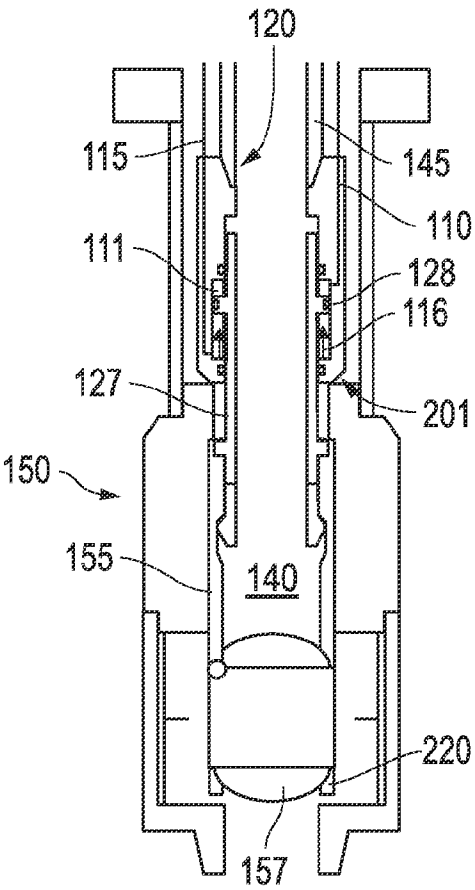
FIG. 2B is a side view of the upper completion securely landing at the lower completion of FIG. 2A.
Figure 2A:
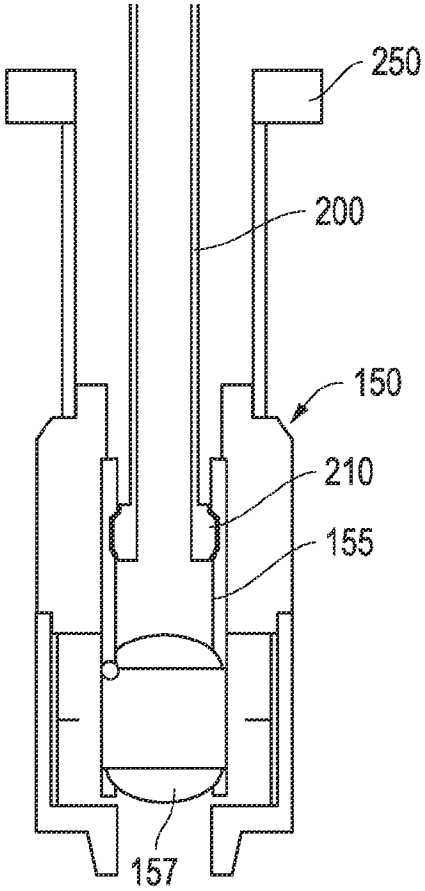
FIG. 2A is a side view of the lower completion of FIG. 1 upon installation and closure of the isolation valve.

Referring now to FIG. 2A is a side view of the lower completion 150 of FIG. 1 is shown immediately upon installation. Specifically, a work string used in finishing out the installation of the lower completion 150 and MFIV 157 is equipped with a work string shift tool 200 at the lower end thereof. The tool 200 includes a latch 210 engaged with the operator 155 of the MFIV 157 in the embodiment shown. Thus, as the work string is removed, following lower completion installation, the upward pull of the tool 200 translates into an upward shift of the operator 155 and closure of the valve 157. Once more, an annularly disposed packer 250 accompanies the lower completion 150 in the embodiment shown. Therefore, well control is immediately maintained via completed installation of the lower completion 150 (i.e. internally via the closed valve 157 and annularly with the depicted packer 250).

Of course, in other embodiments, the MFIV 157 may be run with a dedicated intermediate completion which follows the depicted lower completion 150 installation. Regardless, such intermediate completion is "lower" relative the forthcoming upper completion 120 (see FIG. 2B). Further, work string removal with a tool 200 as depicted may still be employed to automatically attain closure of the MFIV 157 following completed intermediate completion installation.

Referring now to FIG. 2B, the upper completion 120 is shown upon lowering into sealed engagement at an interface 201 with the installed lower completion 150 of FIG. 2A. Note that the shifting tool 127 described in FIG. 1 is shown in latched engagement with the operator 155 of the valve 157. At the same time however, secure landing of the upper completion 150 alone has not resulted in automatic opening of the valve 157. Rather, well control is maintained relative the channel 140 at either side of the MFIV 157 with a sealed valve seat 220 intact.

The avoidance of premature opening of the valve 157 is ensured by the comparatively retracted nature of the shifting tool 127 at the time of upper completion installation. In one embodiment the retracted nature of the tool 127 is promoted by maintaining of pressure on the lower pressurizable chamber 116 via the closing line 115. Thus, it is the affirmative reversal by the operator at surface, via pressurization on the upper chamber 111 through the opening line 110, which allows for opening of the valve 157.

Indeed, referring now to FIG. 2C, a side view of the extendable shifting tool 127 of FIGS. 1 and 2B is shown extending from the upper completion 150 to open the isolation valve 157. As alluded to above, this is achieved by the affirmative pressurization of the upper chamber 111 by the opening hydraulic control line 110 in comparative contrast to control and pressure through the other line 115 and chamber 116. As a result, the valve 157 is opened and production fluid 197 is free to make its way through the channel 140 and production tubing 145 to surface, for example, with the aid of an ESP 160 (see FIG. 1).

In the embodiments depicted herein, pressurization of the upper chamber 111 is utilized as the valve opening maneuver, whereas pressurization of the lower chamber 116 is for valve closing. Thus, upward and downward piston-like movement of the shifting tool 127 may be taken advantage of in a relatively straight forward manner. That is, it may be advantageous to utilize a protruding operator-engaged tool 127 to be further extended in order to open the valve 157 and retracted to achieve closure. So, for example, even if the shifting tool 127 becomes stuck in the extended position closure may be achieved through techniques as described with reference to FIG. 3A below. Nevertheless, in other embodiments alternate orientation and architecture may be utilized, for example, to reverse functionality of the chambers 111, 116 (e.g. and allow retraction of the tool 127 to open the valve 157).

Figure 3B:
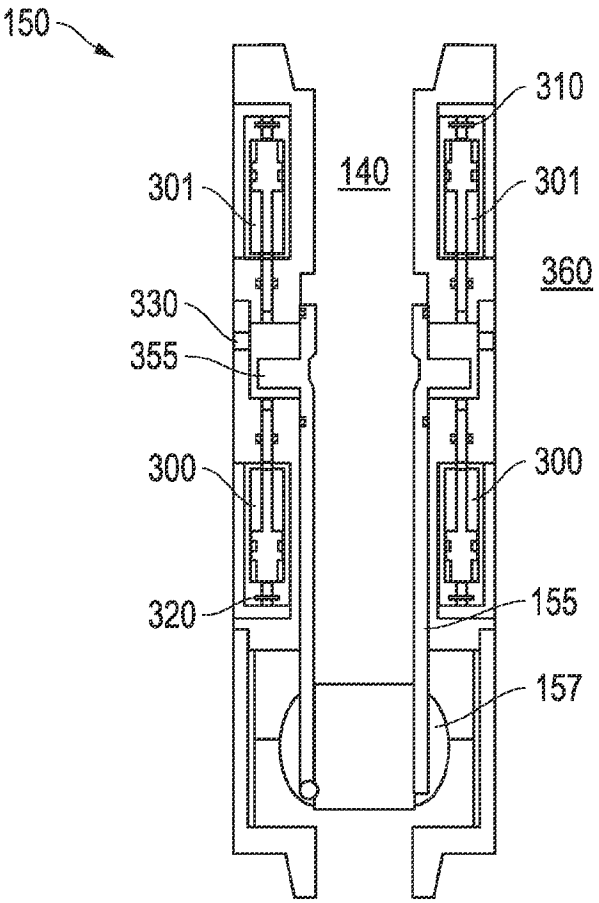
FIG. 3B is a side view of an embodiment of wirelessly actuated piston cartridges for one-time closure or opening of the isolation valve.
Figure 3A:
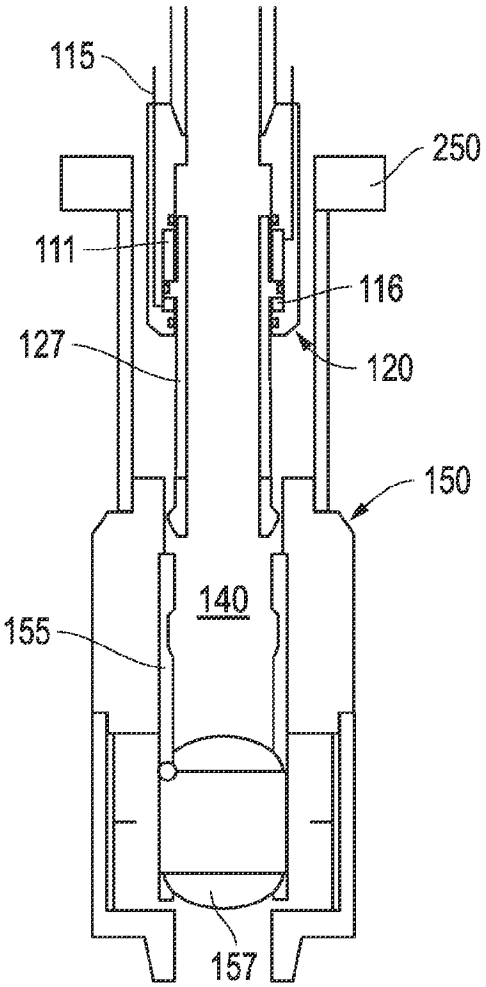
FIG. 3A is a side view of an embodiment of a contingency closure technique for the isolation valve via uphole movement of the upper completion.

Referring now to FIG. 3A, a side view of an embodiment of a contingency closure technique as alluded to above is shown. That is, since closure of the MFIV 157 is achieved by way of an upward shift of the shifting tool 127, this may be done even if there is a failure of the relevant control line 115. More specifically, should control over pressurization of the lower chamber 116 and the tool 127 itself be lost, uphole movement of the upper completion 120 may take place as directed by an operator at surface. Thus, the tool 127 would be moved upward and the valve 157 closed.

Where control over the shifting tool 127 is lost in the manner noted above, the entire upper completion 120 may be removed and serviced so as to restore functionality to the tool 127. Once more, such an undertaking may be fairly efficient and comparable to the initial removal of the work string and tool 200 as depicted in FIG. 2A. Indeed, during a planned servicing of the ESP 160 or other hardware of the upper completion 120, this may be the manner in which closure of the valve 157 is naturally achieved (see FIG. 1). Perhaps even more significant from a time and cost perspective, this would also mean that restoring control over the valve 157 would not require a complete drill-out, workover or removal of the lower completion 150 in order to address the issue. Rather, with the tool 127 and all unitary line hydraulics thereof being self-contained within the upper completion 120, the removal and servicing involved may be a markedly less significant undertaking. Once the shifting tool 127 is pulled out of the well 180 of FIG. 1 the affected hardware may be redressed with new seals and run back in with the upper completion 120.

Referring now to FIG. 3B, another embodiment of for attaining valve control upon failure of a line 110, 115 is depicted. In this embodiment, wirelessly actuated piston cartridges 300, 301 may be utilized for one-time closure or opening of the isolation valve 157. More specifically, where hydraulic control over valve closure is lost, lower cartridges 300 may be triggered to interface a head 355 of the operator 155 to drive it upward in a piston-like fashion. For example, in the embodiment shown, closure burst disks 320 of the cartridges 300 may be set to a predetermined pressure rating such that an operator may direct an intentional annular well pressure to burst the disks 320 and ultimately close the valve 157.

By the same token, this concept may be utilized to attain a one-time opening of the valve 157. That is, where hydraulic control over valve opening is lost, upper cartridges 301 may be triggered to interface the head 355 and drive open the valve 157 via piston-like actuation on the operator head 355. Again, this may also be achieved by way of opening burst disks 310 of the corresponding cartridges 301 which are set at another predetermined pressure rating and annularly controllable by an operator at surface.

In the single-shot valve opening and closing embodiments of FIG. 3B, the functionality of the extendable shifting tool 127 of FIG. 3A is exchanged with the architecture of the lower completion 150 and adjacent annular space 360. That is, as opposed to pulling up on the upper completion 120 of FIG. 3A, an operator head 355 may reciprocate in a manner ported to the annular space 360 (see port 330). Once more, such reciprocation for opening or closing of the valve 157 is regulated through pressure in the annular space 360 as directed by an operator from surface. As a result, embodiments such as that depicted in FIG. 3B may utilize packer placement below the location of the isolation valve 157. This is in contrast to annular placement of a packer 250 above the area of the valve 157, for example, as depicted in the embodiment of FIG. 3A. Of course, a variety of other architectures may also be employed to allow for wireless triggering of cartridges 300, 301. Further, where the valve 157 is closed, the upper cartridges 301 may be triggered through the internal channel 140 as opposed to the annular space 360, irrespective of packer placement.

Figure 4:
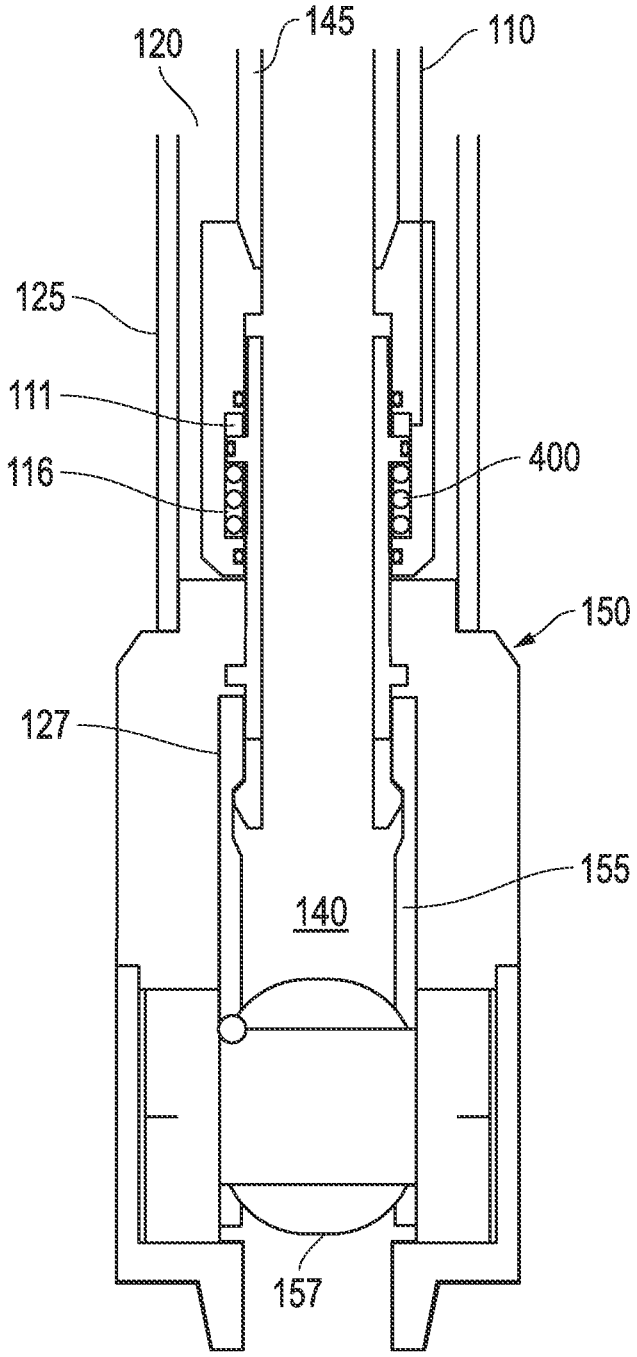
FIG. 4 is a side view of an embodiment of the completions assembly utilizing an embodiment of a fail-safe mechanism at the extendable shifting tool for contingent closure of the isolation valve.

Referring now to FIG. 4, a side view of the completions assembly utilizing an embodiment of a fail-safe mechanism 400 at the extendable shifting tool 127 of the upper completion 120 is shown. In this case, the fail-safe mechanism 400 is a mechanical spring. However, a nitrogen gas spring, or atmospheric bias chambers or other expansive device may be utilized.

The embodiment of FIG. 4 is particularly well suited for addressing contingent closure of the isolation valve 157. For example, where an emergent circumstance arises in which hydraulic control over the shifting tool 127 is lost or compromised, the failure to maintain adequate pressure on the upper chamber 111 may automatically result in expansion of the fail-safe mechanism 400 in the chamber 116 therebelow. Thus, the tool 127 and operator would automatically raise and the MFIV 157 close as depicted in FIG. 4.

Indeed, with such a setup, the opening hydraulic control line 110 may be used in cooperation with the mechanism 400 to open and close the valve 157 without the added requirement of a closing hydraulic control line 115 (see FIG. 1). Rather, control over the valve may be exercised by the degree of pressure that is directed through the single opening control line 110. This means that in addition to avoiding hydraulic coupling between the upper 120 and lower 150 completions, an entire hydraulic line may also be eliminated without sacrifice to control over the valve 157 in the lower completion 150. In fact, in one embodiment, an MFIV 157 equipped with such automatic fail-safe capacity may even operate as a safety valve in and of itself. For example, in an offshore environment where shearing of riser or upper completion hardware takes place, the break in the control line 115 would eliminate pressure on the upper chamber 111 and automatically trigger the expansion of the mechanism 400 in the lower chamber 116 so as to close the valve 157 as described hereinabove.

Such embodiments as depicted in FIG. 4 may be particularly well suited for environments where internal pressure in the production tubing 145 and channel 140 are relatively stable. Thus, the consistency and reliability of the fail-safe mechanism 400 may be more predictable over time, particularly in terms of the interaction with the control line 115 and operating pressures thereof.

Figure 5:
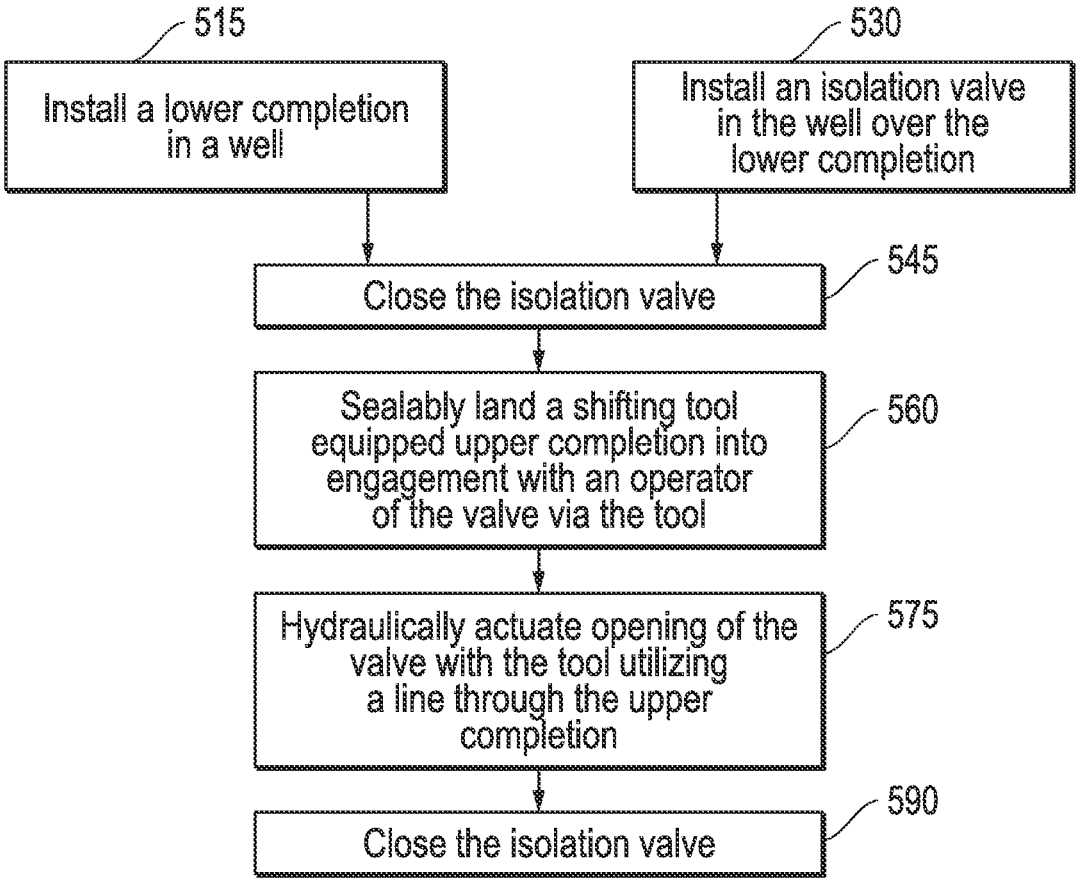
FIG. 5 is a flow-chart summarizing an embodiment of installing a completions assembly and controlling an isolation valve thereof with an extendable shifting tool.

Referring now to FIG. 5, a flow-chart is shown summarizing an embodiment of installing a completions assembly and controlling an isolation valve thereof with an extendable shifting tool. As shown at 515 and 530, the lower completion is installed with the isolation valve thereabove. That is, as detailed herein, they may be installed in conjunction with one another or alternatively, the isolation valve may be subsequently installed over or at the access point to the lower completion so as to maintain well control thereat. Indeed, as indicated at 545, the valve is closed as these initial completions are finished out.

Continuing with reference to FIG. 5, the upper completion is later sealably landed with a shifting tool thereof becoming engaged with an operator of the isolation valve (see 560). Yet, this takes place in advance of hydraulically opening the valve by way of a line through the upper completion as indicated at 575.

At a later point in time, the valve may be closed as noted at 590 and detailed hereinabove. More specifically, another hydraulic control line may direct such closure or re-closure of the valve. Alternatively, raising up of the entire upper completion may be used to close the valve, for example, where failure of hydraulic tool shifting capabilities presents. Along these lines, a fail-safe type of automatic closure mechanism may also be employed or even a supplemental plunger-type of wireless pressure driven actuation. In one embodiment this latter type of single-shot actuation may also be used in opening the valve where necessary.

Embodiments described hereinabove include surface operable MFIV hardware that avoids reliance on hydraulic couplings between upper and lower completions. Once more such capacity is provided in a manner that also avoids use of a protruding shifting tool at the lower end of an upper completion that is prone to begin opening the MFIV before the upper completion is sealably landed in place. These achievements are rendered practical by use of an extendable shifting tool at the lower end of the upper completion which is hydraulically controlled thereat for extension and/or retraction.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments herein are described with reference to a single MFIV at the junction of upper and lower completions. However, other intervening isolation valves may operate along the same principles. This may even include stacking of multiple barrier valves throughout a completion assembly, each hydraulically operable. Regardless, the foregoing description should not be read as pertaining only to the precise structures described and shown in the accompanying drawings, but rather should be read as consistent with and as support for the following claims, which are to have their fullest and fairest scope.

We claim:

1. A method of maintaining well control during completions assembly installation, the method comprising:

installing a lower completion in a well having fluid access to a surrounding well formation;

closing an isolation valve over the lower completion for well control thereat;

landing an upper completion into interface with the installed lower completion while keeping the valve closed to fluid communication between the completions; and extending a retracted shifting tool of the upper completion to an extended position for opening the fluid communication after said landing.

2. The method of claim 1 wherein said closing comprises removing a workstring from the well after said installing, the workstring including a shift tool at an end thereof to facilitate said closing.

3. The method of claim 1 wherein said extending comprises actuating the extending of the shifting tool with a hydraulic control line run through the upper completion to a location of the shifting tool.

4. The method of claim 3 wherein said landing further comprises engaging an operator arm of the valve with the tool, said extending further comprising moving the arm to attain the opening.

5. The method of claim 4 further comprising reclosing the valve after said extending.

6. The method of claim 5 wherein said reclosing comprises actuating a retraction of the shifting tool with another hydraulic control line run through the upper completion to a location of the tool.

7. The method of claim 5 wherein said reclosing comprises withdrawing the upper completion in an uphole direction away from the interface with the lower completion.

8. The method of claim 5 wherein said reclosing comprises wirelessly triggering at least one single-shot pressure actuated cartridge to move the operator arm in a manner effecting closure of the valve.

9. The method of claim 5 wherein said reclosing comprises:

lowering hydraulic pressure through the line; and expanding a mechanism in a chamber at the shifting tool for retraction thereof.

10. The method of claim 9 wherein said lowering is a result of line failure and said expanding is an automatic fail-safe expanding of the mechanism in response to the failure.

* * * * *